US008025370B2

(12) United States Patent
Nagate et al.

(10) Patent No.: US 8,025,370 B2
(45) Date of Patent: Sep. 27, 2011

(54) LIQUID EJECTING HEAD AND LIQUID EJECTING APPARATUS

(75) Inventors: Toru Nagate, Matsumoto (JP); Toshifumi Sakai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 249 days.

(21) Appl. No.: 12/257,247

(22) Filed: Oct. 23, 2008

(65) Prior Publication Data

US 2009/0109256 A1 Apr. 30, 2009

(30) Foreign Application Priority Data

Oct. 24, 2007 (JP) ..... 2007-276812

(51) Int. Cl.
*B41J 2/045* (2006.01)
*B41J 2/175* (2006.01)

(52) U.S. Cl. ..... 347/71; 347/93

(58) Field of Classification Search ..... 347/68–72, 347/94, 93

See application file for complete search history.

(56) References Cited

U.S. PATENT DOCUMENTS

| | | | | |
|---|---|---|---|---|
| 6,250,753 | B1 * | 6/2001 | Nishiwaki et al. | 347/94 |
| 2003/0210307 | A1 * | 11/2003 | Ito et al. | 347/71 |
| 2004/0056937 | A1 * | 3/2004 | Ito | 347/93 |

FOREIGN PATENT DOCUMENTS

| | | |
|---|---|---|
| JP | 2003-311951 | 11/2003 |
| JP | 2003-311952 | 11/2003 |
| JP | 2006-272806 | 10/2006 |
| JP | 2007-076093 | 3/2007 |

* cited by examiner

*Primary Examiner* — Geoffrey Mruk

(74) *Attorney, Agent, or Firm* — Kilpatrick Townsend & Stockton LLP

(57) ABSTRACT

A liquid ejecting head includes: a supply channel member including a plurality of supply channel plates, and the supply channel including supply holes provided through the respective supply channel plates and a supply groove formed by removing part of one of adjacent supply channel plates in terms of the direction of thickness thereof for communicating the respective supply holes; a pressure generating element that provides a pressure to the pressure generating chamber; a supply communication channel that connects a storage unit having the liquid stored therein and a reservoir, the supply communication channel being formed through a pressure chamber plate and the supply channel member in the direction of thickness thereof, the supply channel plates having the supply groove being formed with a recess having the substantially same depth as the supply groove at an area corresponding to the supply communication channel; and a filter unit having a plurality of filter holes provided on the bottom of the recess.

5 Claims, 7 Drawing Sheets

LIQUID EJECTING HEAD AND LIQUID EJECTING APPARATUS

CROSS REFERENCES TO RELATED APPLICATIONS

The present invention claims priority on the basis of Japanese Patent Application No. 2007-276812 filed in the Japanese Patent Office on Oct. 24, 2007, the entire contents of which are incorporated herein by reference.

BACKGROUND

1. Technical Field

The present invention relates to a liquid ejecting head and a liquid ejecting apparatus.

2. Related Art

As a representative example of a liquid ejecting head, an ink jet printhead of capable ejecting ink drops from nozzles is exemplified. The ink jet printhead generally includes a plurality of pressure generating chambers which communicate with nozzles and a reservoir (common ink chamber) which communicates the plurality of pressure generating chambers (cavity) respectively. Ink stored in a storage unit such as an ink cartridge is taken into the reservoir, is supplied from the reservoir to the respective pressure generating chambers, and is pressurized by a piezoelectric actuator or the like, so that the ink drops are ejected from the nozzles.

As the ink jet printhead described above, the one having a filter for removing foreign substances in ink disposed in a channel which communicates a storage unit and a reservoir is disclosed in JP-A-2007-76093 and JP-A-2003-311951.

As the filter described above, there are types such as those formed by electroforming or those formed by punching a number of filter holes (fine holes) through a metal or a resin film. However, either of these filters might suffer from occurrence of warp (curl) at the time of manufacture. Then, in the case of a structure in which a filter is joined on a substrate having ink flow channels such as the pressure generating chamber formed thereon, there arise problems such as defective joining caused by the curl of the filter (for example, separation of the filter) or deterioration of positioning accuracy of the filter with respect to the substrate, whereby desirable supply of ink to the reservoir via the filter might fail. For example, in JP-A-2006-272806, provision of concavo-convexo on a metal film as a filter for restraining curl is proposed. However, even with this structure, it is also difficult to restrain occurrence of curling completely.

Even with the structure in which the filter is integrated in a thin plate laminated with a substrate formed with the ink flow channels as described in JP-A-2003-311951, there might occur problems such as the defective joining and defective ink supply due to the occurrence of the curl on the periphery of the filter.

These problems are present not only in the ink jet printhead which ejects ink drops, but also in the liquid ejecting head ejecting other liquid drops.

SUMMARY

An advantage of some aspects of the invention is that a liquid ejecting head and a liquid ejecting apparatus which are able to supply liquid desirably from a storage unit to a reservoir and eject desirably as liquid drops from nozzles are provided.

A liquid ejecting head according to an aspect of the invention includes a pressure chamber plate having a pressure generating chamber which communicates with a nozzle for ejecting liquid drops; a reservoir plate formed with a reservoir in which liquid to be supplied to the pressure generating chamber is stored temporarily; a supply channel member arranged between the pressure chamber plate and the reservoir plate and formed with a supply channel which communicates the reservoir and the pressure generating chamber; and a pressure generating element that provides a pressure to the pressure generating chamber; the supply channel member includes a plurality of supply channel plates, the supply channel includes supply holes penetrated through the respective supply channel plates and a supply groove formed by removing part of one of adjacent supply channel plates in terms of the direction of thickness thereof for communicating the respective supply holes; a supply communication channel that connects a storage unit in which the liquid is stored and the reservoir; the supply communication channel being formed substantially through the pressure chamber plate and the supply channel member in the direction of thickness thereof, the supply channel plate having the supply groove being formed with a recess having the same depth as the supply groove at an area corresponding to the supply communication channel, and a filter unit having a plurality of filter holes provided on the bottom of the recess.

In this configuration, since the filter unit is formed on the bottom of the recess formed on the relatively thick supply channel plate, rigidity of the periphery of the filter unit is significantly improved. Therefore, occurrence of the warp of the filter unit is restrained. Therefore, the liquid is desirably supplied from the storage unit to the reservoir. Also, by forming the recess to have the same depth as the supply groove, the recess and the supply groove for the filter unit are easily obtained.

Preferably, the flow channel unit further includes a compliance plate having a compliance portion which is joined on the surface of the reservoir plate opposite from the supply channel plate and is deformed by the pressure change in the interior of the reservoir, and a nozzle plate formed with the nozzle and joined to the compliance plate, and the compliance plate is formed with the compliance portion at least at a portion opposing an opening of the supply channel on the side of the reservoir by removing part of the compliance plate in terms of the direction of thickness. In this configuration, the pressure change in the interior of the reservoir is restrained by the compliance portion, so that the liquid drops are desirably ejected constantly.

Preferably, the compliance plate is formed with the compliance portion at a portion opposing the opening of the supply channel on the side of the reservoir and a position opposing the supply communication channel. In this configuration, the restraint of the pressure change in the interior of the reservoir is further ensured.

Preferably, the compliance plate includes a through hole penetrating through the compliance plate in the direction of thickness formed at a portion opposing the supply communication channel, and includes the compliance portion by removing part of the nozzle plate in the direction of thickness at a position opposing the through hole of the nozzle plate. In this configuration, the distance between the filter unit and the compliance portion is increased, and hence the pressure change in the interior of the reservoir is restrained even when the size of the compliance portion is reduced to a relatively small size.

Preferably, the reservoir plate includes a beam portion in an area between a portion opposing the supply channel and a portion opposing the supply communication channel. In this configuration, the supply channel plates (supply channel members) are reliably supported, so that occurrence of the problem such that the supply channel plates are bent and separated is prevented.

The invention also provides a liquid ejecting apparatus having the liquid ejecting head configured as described above. In this configuration, the liquid ejecting apparatus having an improved reliability is achieved.

Other features and objects of the invention will be apparent from the description in this specification referring to the attached drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail on the basis of embodiments.

First Embodiment

Figure 1:
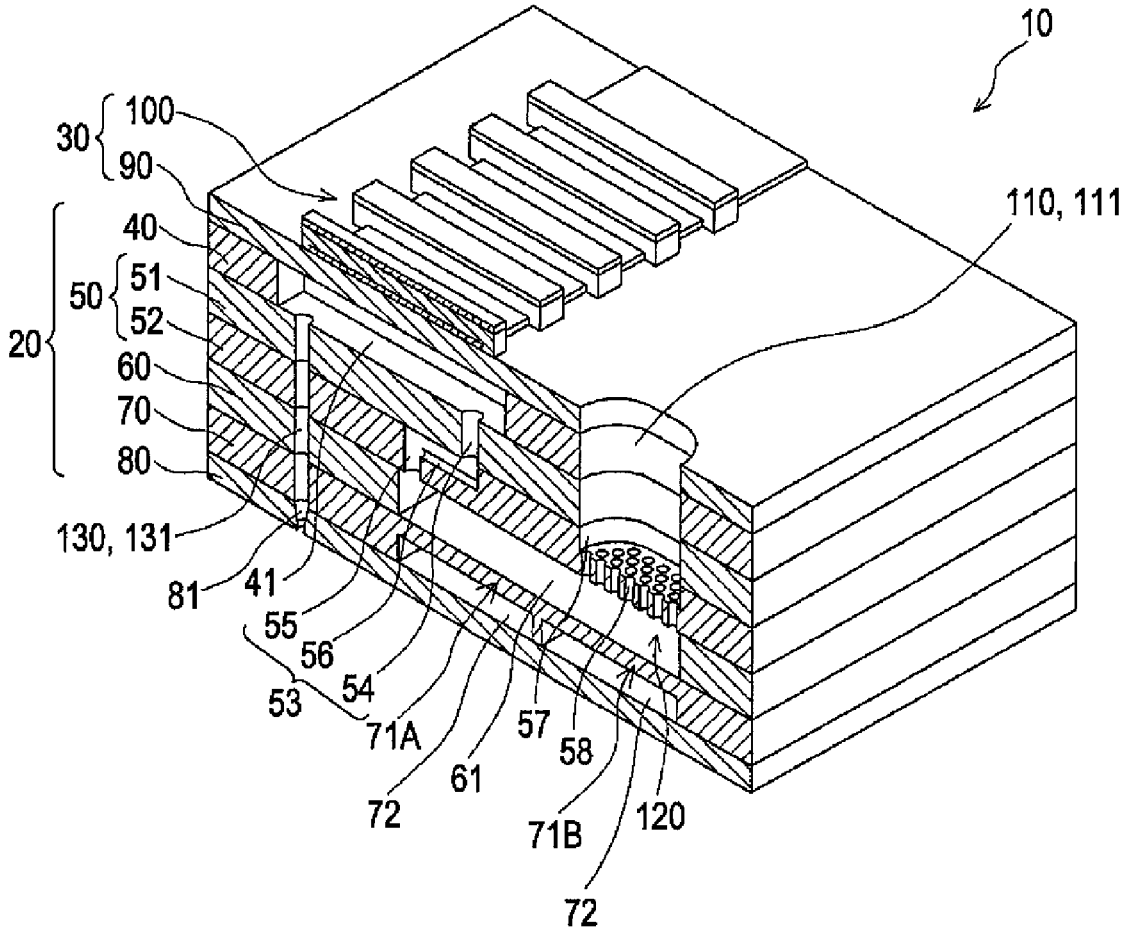
FIG. 1 is a schematic perspective view of a printhead according to a first embodiment.
Figure 2A:
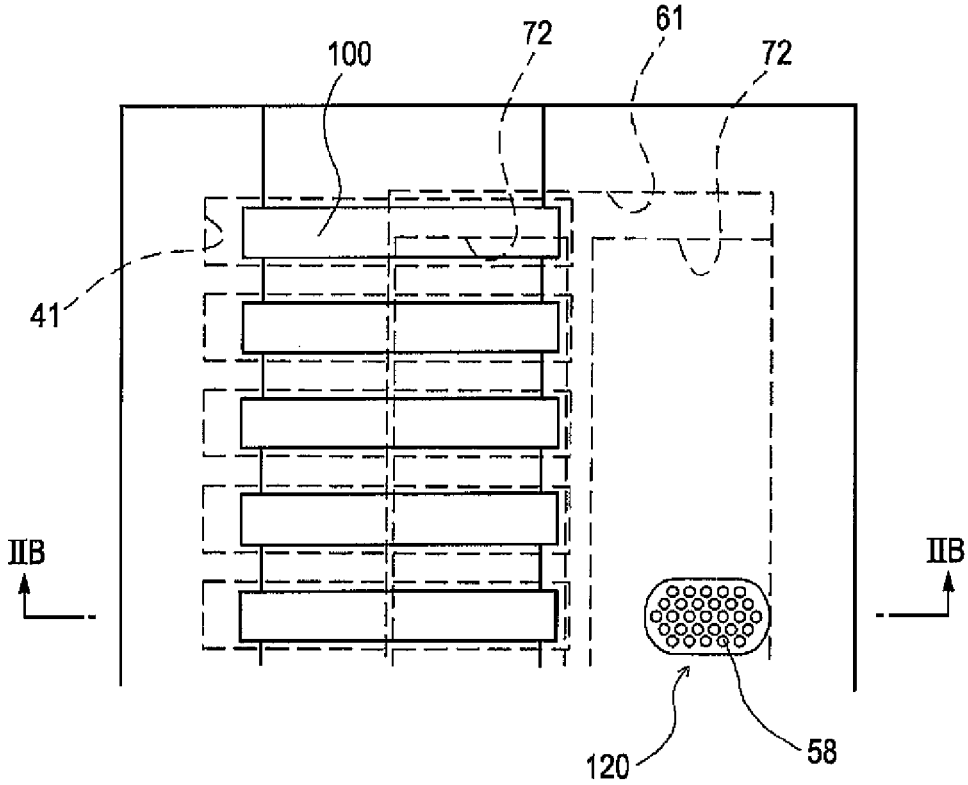
FIG. 2A is a plan view of the printhead according to the first embodiment.
Figure 2B:
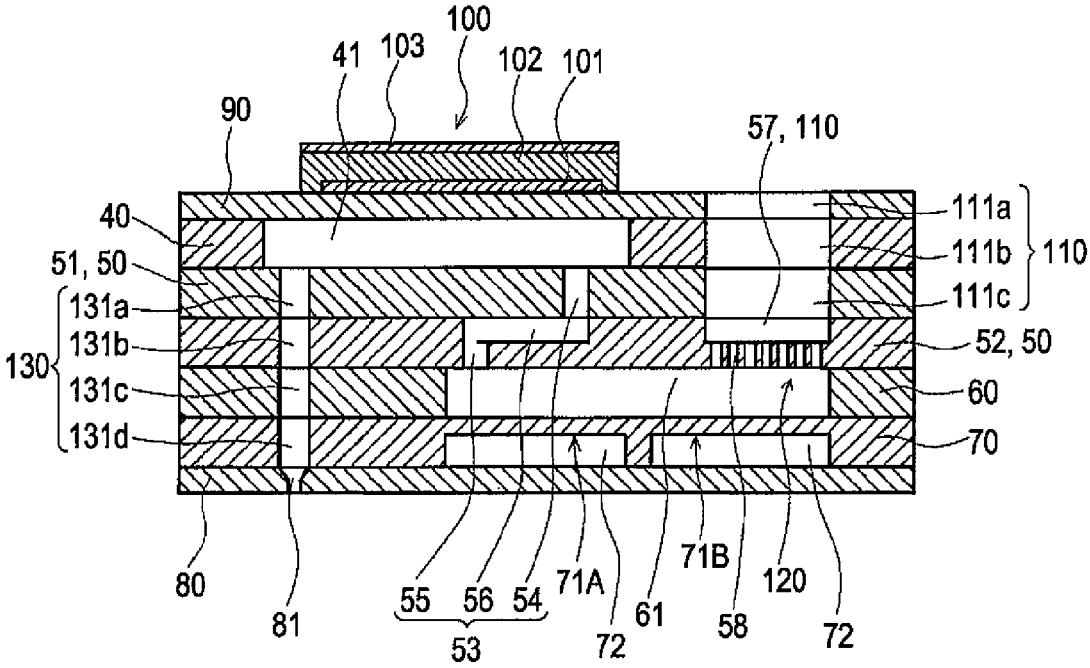
FIG. 2B is a cross-sectional view of the printhead according to the first embodiment.

FIG. 1 is a schematic perspective view of an ink jet printhead as an example of a liquid ejecting head according to a first embodiment of the invention. FIG. 2A is a plan view of the ink jet printhead; and FIG. 2B is a cross-sectional view of the ink jet printhead taken along the line IIB-IIB in FIG. 2A.

As shown in the drawing, an ink jet printhead 10 in the first embodiment includes a flow channel unit 20 formed of a plurality of laminated metal plates and formed with an ink flow channel, and an actuator device 30 fixed to the flow channel unit 20.

The flow channel unit 20 includes a pressure chamber plate 40, a supply channel member 50 having first and second first supply channel plates 51 and 52, a reservoir plate 60, a compliance plate 70, and a nozzle plate 80.

The pressure chamber plate 40 is formed with a plurality of pressure generating chambers 41 which constitute part of the ink flow channel arranged in parallel in the direction of width thereof. The respective pressure generating chambers 41 are provided so as to penetrate through the pressure chamber plate 40 in the direction of thickness. The actuator device 30 is arranged on one side of the surfaces of the pressure chamber plate 40, and openings on one side of the pressure generating chambers 41 are sealed by the actuator device 30.

The actuator device 30 includes an oscillating plate 90 to be fixed to the pressure chamber plate 40 and piezoelectric elements 100 to be provided on the oscillating plate 90, and openings on one side of the pressure generating chambers 41 are sealed by the oscillating plate 90. In other words, wall surfaces on one side of the pressure generating chambers 41 are formed by the oscillating plate 90. The piezoelectric elements 100 are provided in areas opposing the respective pressure generating chambers 41 on the oscillating plate 90 respectively. The piezoelectric elements 100 each include a lower electrode film 101 provided continuously on the oscillating plate 90, a piezoelectric layer 102 provided independently for each of the pressure generating chambers 41, and an upper electrode film 103 provided on the piezoelectric layer 102. In other words, in this embodiment, the lower electrode film 101 serves as a common electrode of the respective piezoelectric elements 100, and the upper electrode film 103 serves as an individual electrode independent for the each piezoelectric element 100. The piezoelectric layer 102 is formed by bonding a green sheet formed of a piezoelectric material or by printing.

The reservoir plate 60 is joined to the other side of the pressure chamber plate 40 via the supply channel member 50. The reservoir plate 60 is formed with a reservoir 61 for storing ink distributed to the respective plurality of pressure generating chambers 41 formed in the pressure chamber plate 40 temporarily. The reservoir 61 is provided so as to penetrate through the reservoir plate 60 in the direction of thickness and to have a length extending over the rows of the plurality of pressure generating chambers 41 arranged in parallel.

The supply channel member 50 arranged between the pressure chamber plate 40 and the reservoir plate 60 includes two plates, that is, the first supply channel plate 51 and the second supply channel plate 52 to be joined to the first supply channel plate 51. Openings of the pressure generating chambers 41 on the other side are sealed by the first supply channel plate 51. On the other hand, the second supply channel plate 52 is joined to the reservoir plate 60, and an opening of the reservoir 61 on one side is sealed by the second supply channel plate 52. The supply channel member 50 including the first and second supply channel plates 51 and 52 is formed with a plurality of supply channels 53 which communicate the respective pressure generating chambers 41 and the reservoir 61 respectively.

The supply channels 53 each are defined by a first supply hole 54 provided in the first supply channel plate 51 so as to penetrate therethrough in the direction of thickness and a second supply hole 55 provided in the second supply channel plate 52 so as to penetrate therethrough in the direction of thickness, and a supply groove 56 which connects the first and second supply holes 54 and 55. The first supply holes 54 open near ends of the pressure generating chambers 41 on one side in the longitudinal direction respectively, and the second supply holes 55 open near an end of the reservoir 61 on the side of the pressure generating chambers 41 respectively. The supply grooves 56 are formed on the surface of the second supply channel plate 52 on the side of the first supply channel plate 51 by removing partly in the direction of thickness. In this embodiment, the supply grooves 56 each are formed by a depth about half the thickness of the second supply channel plate 52 and communicate the first supply hole 54 and the second supply hole 55.

The oscillating plate 90, the pressure chamber plate 40, and the first and second supply channel plates 51 and 52 described above are formed with a supply communication channel 110 which includes supply communication holes 111*a* to 111*c* substantially penetrating through the plurality of plates and communicate with the reservoir 61. The supply communication channel 110 is connected to a storage unit of an ink cartridge or the like, not shown, and ink is supplied into the reservoir 61 from the storage unit via the supply communication channel 110.

In addition, a filter unit 120 for trapping foreign substances in ink supplied to the reservoir 61 is arranged in the supply communication channel 110. In an aspect of the invention, the filter unit 120 is integrally provided with the second supply channel plate 52 having the supply channel member 50, more specifically, the supply groove 56 formed therein. The second supply channel plate 52 is formed with a recess 57 which constitutes the supply communication channel 110 and has the same depth as the supply groove 56, and the bottom of the recess 57 is formed with a number of filter holes 58 as through holes. In other words, the bottom of the recess 57 formed with a plurality of the filter holes 58 functions as the filter unit 120.

The compliance plate 70 is joined to the surface of the reservoir plate 60 on the opposite side from the supply channel member 50 to close the other opening of the reservoir 61, and has a compliance portion 71 which is deformable due to the pressure change in the reservoir 61. More specifically, the compliance plate 70 is formed with recesses 72 on the surface opposite from the reservoir 61, and the bottom of the recesses 72, that is, portions of the compliance plate 70 thinner than other portions function as the compliance portion 71. The compliance portion 71 is deformed in association with the pressure change in the reservoir 61, so that the pressure in the reservoir 61 is maintained in a substantially constant state.

In this embodiment, compliance portions 71A and 71B are formed on the reservoir plate 60 at portions where openings of the second supply holes 55 on the reservoir 61 side oppose and a portion where the supply communication channel 110 opposes. The portions in the reservoir 61 are subjected to strong flows of ink when ink drops are ejected. In other words, these portions are specifically subjected to the pressure change in the reservoir 61. Therefore, with the provision of the compliance portions 71A and 71B in these portions, the pressure change in the reservoir 61 is effectively absorbed by the deformation of the compliance portions 71A and 71B. The compliance portions 71A and 71B do not necessarily have to be provided independently. However, when the surface area of the compliance portion 71 is too large, since rigidity of the compliance plate 70 is lowered and a problem of bending of the plate arises, it is necessary to take this point into consideration.

The nozzle plate 80 is joined to the compliance plate 70, and is formed with a plurality of nozzles 81 corresponding to the respective pressure generating chambers 41. The nozzles 81 are respectively in communication with the pressure generating chambers 41 via a nozzle communication channel 130 provided in the first and second supply channel plates 51 and 52, the reservoir plate 60, and the compliance plate 70 as described above so as to penetrate therethrough. More specifically, the first and second supply channel plates 51 and 52, the reservoir plate 60, and the compliance plate 70 are formed with nozzle communication holes 131*a* to 131*d* which penetrate through the respective plates, and the nozzle communication channel 130 is formed by these nozzle communication holes 131*a* to 131*d*. The each nozzle 81 formed in the nozzle plate 80 communicates with a portion of the respective pressure generating chambers 41 near the other end in the longitudinal direction via the nozzle communication channel 130.

The pressure chamber plate 40 which constitutes the flow channel unit 20 described above, the first and second supply channel plates 51 and 52, the reservoir plate 60, and the compliance plate 70 are formed of metal plates such as stainless steel (SUS) or the like. These plurality of plates are respectively formed of a material such as a metallic plate having the same thickness. In other words, the respective plates are each formed of the same metal plate. In this manner, by forming the plurality of plates of the same material, the material cost is significantly reduced. Therefore, the ink jet printhead having the configuration in this embodiment may be manufactured at a relatively low cost. In addition to the above-described plates, the nozzle plate 80 may also be formed of the same metal plate as other plates as long as the ink drop discharging feature is preferably maintained.

In the ink jet printhead configured as described above, ink is taken from the ink cartridge (storage unit) into the reservoir 61 via the supply communication channel 110, then after having filled the interior of the ink flow channels from the reservoir 61 to the nozzles 81 with ink, a voltage is applied to the respective piezoelectric elements 100 corresponding to the respective pressure generating chambers 41 according to recording signals from a drive circuit, not shown, to cause the oscillating plate 90 to be deflected together with the respective piezoelectric elements 100, whereby the pressure in the respective pressure generating chambers 41 is increased, and ink drops are ejected from the respective nozzles 81.

In the configuration of the ink jet printhead described above, the pressure generating chambers 41 and the nozzles 81 communicate via the nozzle communication channels 130, and hence the flow channels from the pressure generating chambers 41 to the nozzles 81 are long. Therefore, when ejecting ink drops from the nozzle 81, the flow of ink flowing inversely from the pressure generating chambers 41 to the first supply holes 54 might become stronger than the flow of ink flowing from the pressure generating chambers 41 to the nozzles 81. However, as described above, since the flow channel resistance of the supply channels 53 is increased by providing the supply grooves 56 provided in the direction of the surface of the second supply channel plate 52 which constitutes the supply channel member 50, the reverse flow of ink is restrained, and the ink flows desirably from the pressure generating chambers 41 toward the nozzle 81.

At this time, although ink supplied from the ink cartridge to the supply communication channel 110 may contain foreign substances, these foreign substances are reliably removed by the filter unit 120. Therefore, occurrence of a problem such as nozzle clogging due to the foreign substances in the ink is prevented, and desirable ejection ink drops is constantly ensured.

As describe above, the filter unit 120 is formed on the bottom of the recess 57 formed in the second supply channel plate 52. In other words, the thickness of the second supply channel plate 52 around the filter unit 120 is larger than the filter unit 120. Accordingly, the rigidity of the filter unit 120 is substantially improved and deformation of the filter unit 120 occurred, for example, when the filter holes 58 are formed by punching, or by the pressure (flow) of ink is restrained.

With the provision of the filter unit 120 configured as described above formed integrally with the second supply channel plate 52, the number of components is decreased, and the manufacture is facilitated, so that reduction of the manufacturing cost is achieved.

Figure 3A:
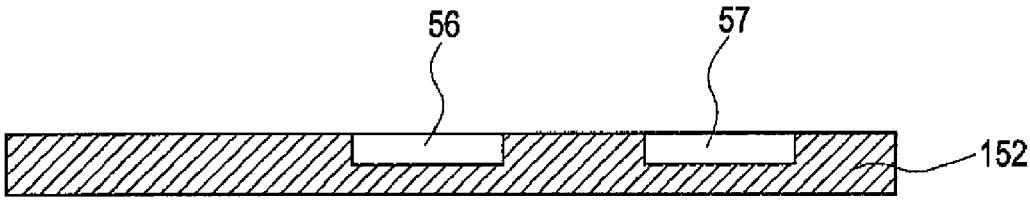
FIGS. 3A to 3C are cross-sectional views showing a method of manufacturing a second supply channel plate according to the first embodiment.

The second supply channel plate 52 having the filter unit 120 is formed, for example, in the following procedure. As shown in FIG. 3A, one of the surfaces of a metal plate 152 as a material of the second supply channel plate 52 is subjected to half etching by plasma etching or electroforming etching or the like to form the supply groove 56 and the recess 57 which constitutes the supply communication channel 110 at the same time. As described above, the supply groove 56 and the recess 57 have the same depth, the supply groove 56 and the recess 57 can be formed by etching at the same time. The supply groove 56 and the recess 57 may be formed, for example, laser processing. The term "same depth" here allows slight difference in depth due to the manufacture error. More specifically, the difference within 5% of the thickness of the metal plate is included in the concept of the same depth.

Figure 3B:
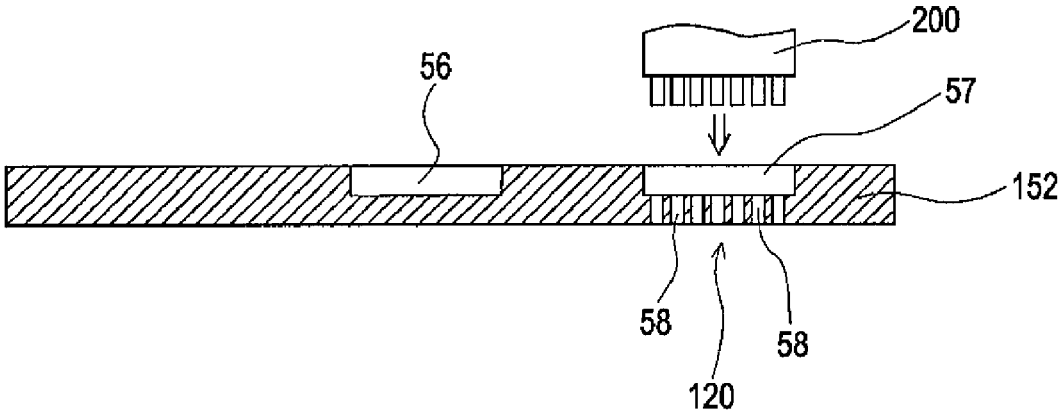
Figure 3C:
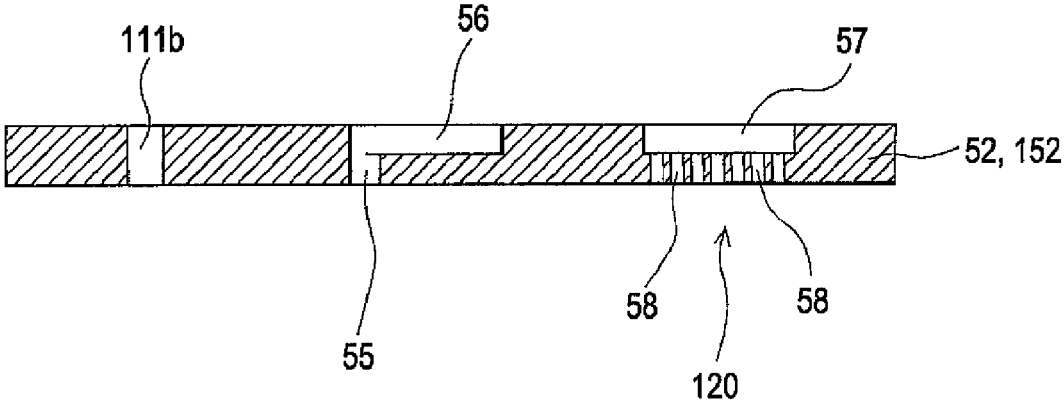

Subsequently, as shown in FIG. 3B, the plurality of filter holes 58 are formed on the bottom of the recess 57 by driving a punch 200 of a predetermined shape in a metal plate 152, that is, by a punching process. Accordingly, the filter unit 120 is formed integrally with the metal plate 152. Subsequently, as shown in FIG. 3C, the metal plate 152 is etched again to form the nozzle supply communication hole 111*b* and the second supply hole 55 so as to penetrate through the direction of thickness of the metal plate 152. Accordingly, the second supply channel plate 52 integrally having the filter unit 120 is manufactured. In the example shown above, the second supply hole 55 is formed by etching. However, the invention is not limited thereto, and the filter holes 58 may be formed by the punching process.

In this manner, by providing the filter unit 120 integrally with the second supply channel plate 52, the recess 57 and the supply groove 56 may be formed simultaneously. Therefore, the manufacturing method is the same as those in the related art other than the process of forming the filter holes 58, and complication of the manufacturing method is restrained. By the provision of the filter unit 120 integrally with the plate (second supply channel plate 52) which constitutes the flow channel unit 20, positioning of the filter and the supply communication channel at high degree of accuracy, which is required when using a filter separate from the plate, is not necessary. As a matter of course, a problem of curling of the filter at the time of manufacture is prevented. Therefore, yield is significantly improved, and reduction of the manufacturing cost is also achieved.

Second Embodiment

Figure 4:
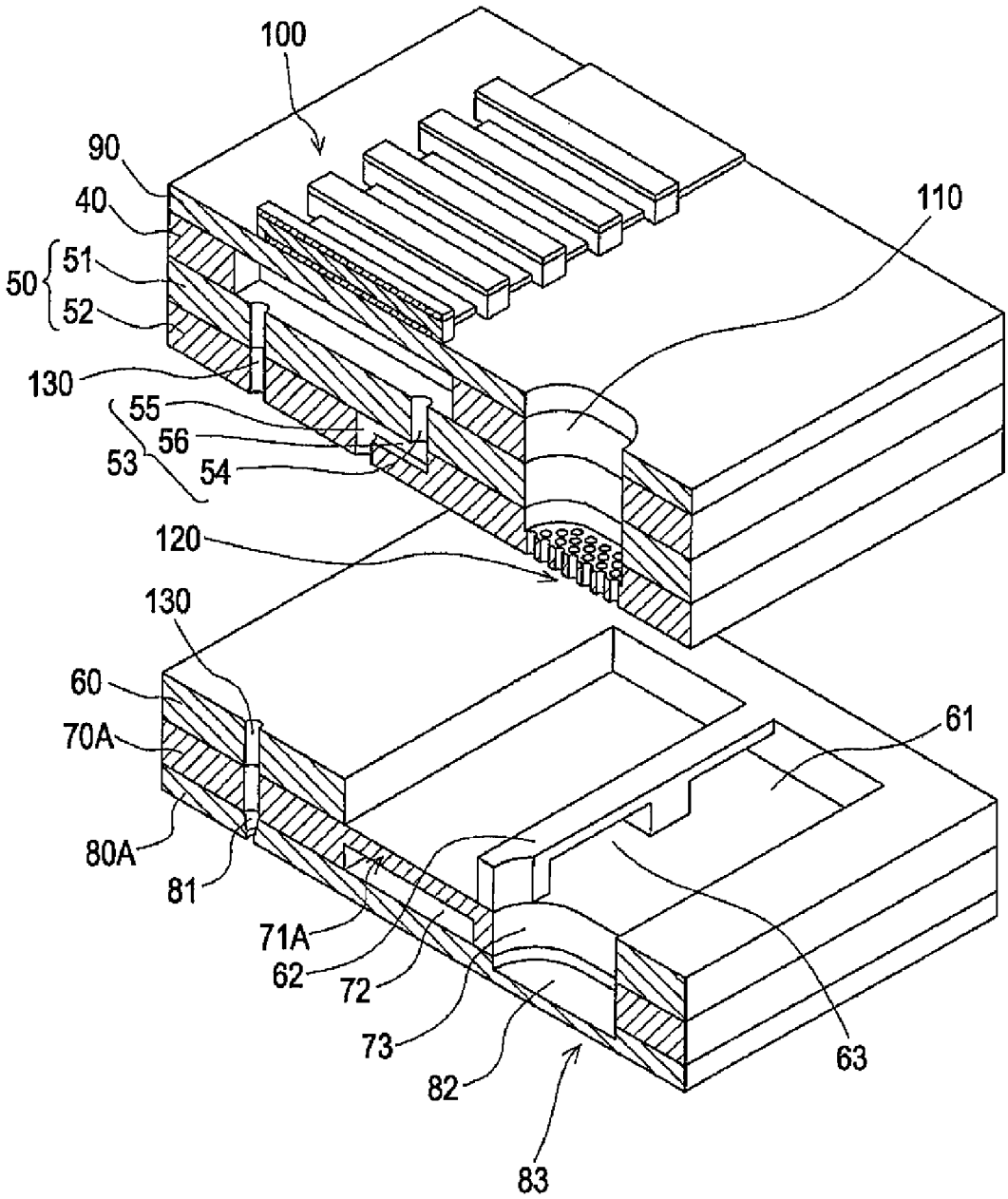
FIG. 4 is a schematic perspective view of the printhead according to a second embodiment.
Figure 5A:
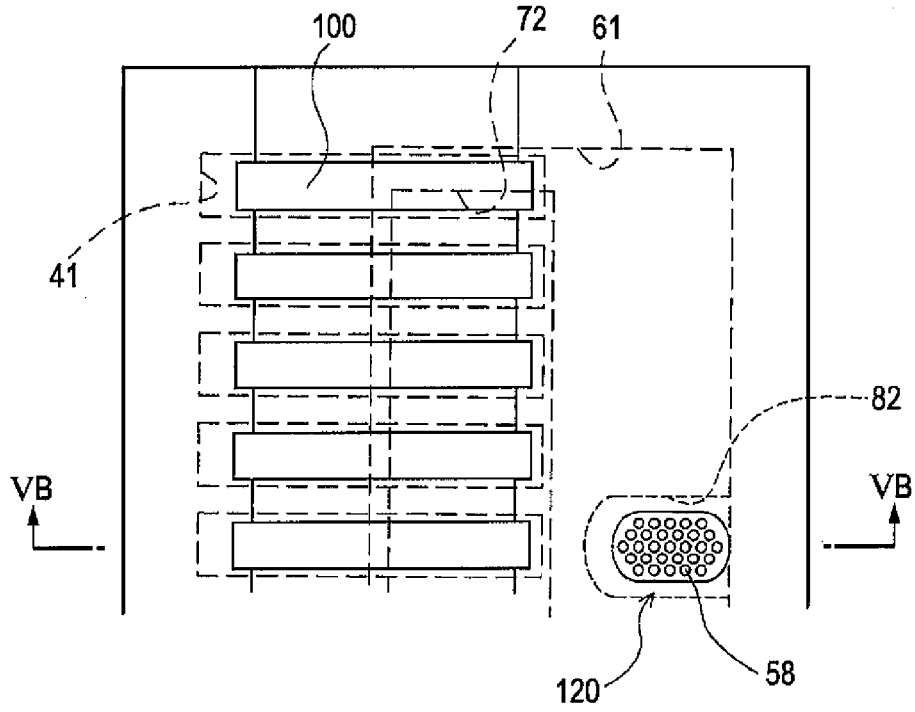
FIG. 5A is a plan view of the printhead according to the second embodiment.
Figure 5B:
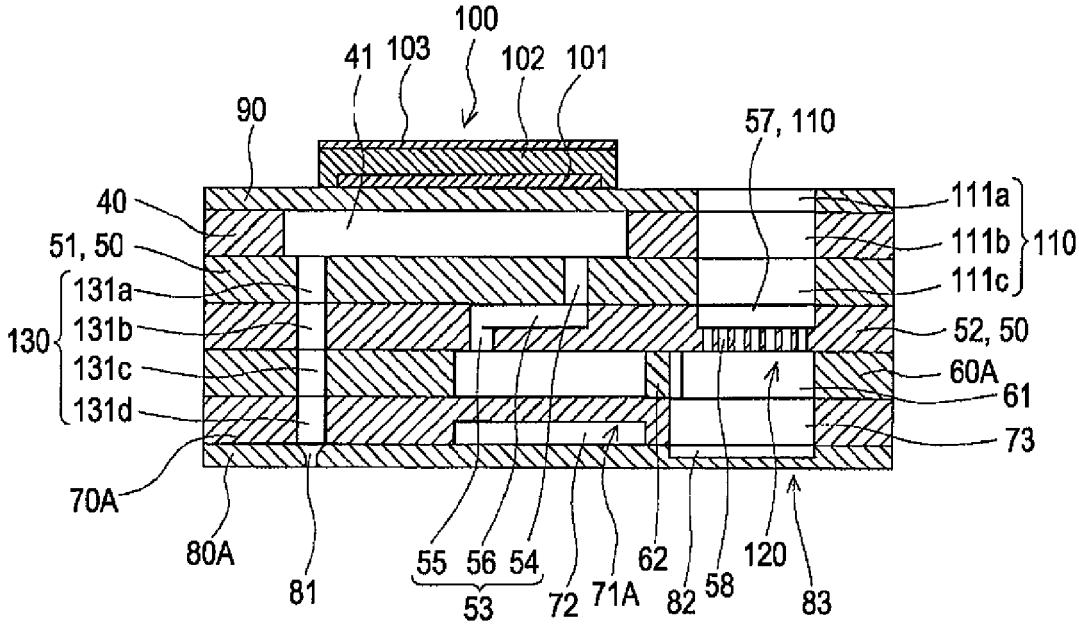
FIG. 5B is a cross-sectional view of the printhead according to the second embodiment.

FIG. 4 is a perspective view schematically showing an ink jet printhead according to a second embodiment, and FIGS. 5A and 5B are a plan view and a cross-sectional view taken along the line VB-VB, respectively.

The second embodiment is a modification of the compliance portion and other configurations are the same as in the first embodiment. As shown in FIG. 4 and FIGS. 5A and 5B, a compliance plate 70A includes a through hole 73 which penetrates through the compliance plate 70A in the direction of thickness in an area opposing the supply communication channel 110. This through hole 73 is formed to be slightly wider than the supply communication channel 110 in the opening surface area. A nozzle plate 80A in an area opposing the through hole 73 is provided with a recess 82 formed by removing part of the nozzle plate 80A in the direction of thickness. The bottom of the recess 82 corresponds to a compliance portion 83.

In the configuration in the second embodiment, a relatively wide space (through hole 73) is provided immediately below the filter unit 120, the distance to the compliance portion 83 is sufficiently secured. In other words, the pressure of ink passed through the filter unit 120 is restrained by ink itself present between the filter unit 120 and the compliance portion 83 to some extent. Therefore, even when the surface area of the compliance portion 83 is relatively small, the pressure change in the reservoir 61 is reliably restrained.

The rigidity of the nozzle plate 80A does not have to be reduced excessively. When the compliance portion 83 is formed on the nozzle plate 80A by a relatively large surface area, oscillations due to the deformation of the compliance portion 83 are transmitted entirely to the nozzle plate 80A, which might affect ejection of ink drops from the nozzles 81. However, in the configuration of the second embodiment, only a relatively small surface area such as the surface area slightly larger than the filter unit 120 is sufficient for the compliance portion 83, and hence the pressure change in the reservoir 61 is reliably restrained without affecting ejection of the ink drops.

A reservoir plate 60A in the second embodiment includes a beam portion 62 extending along the direction of the row of the pressure generating chambers 41 in the reservoir 61. In other words, the beam portion 62 extends in an area of the reservoir plate 60 between the area opposing the supply channels 53 and the area opposing the supply communication channel 110. The beam portion 62 extends in the direction intersecting the direction of flow of ink flowing toward the supply channels 53 in the reservoir 61, and hence opening 63 having a size which does not hinder the flow is formed therethrough.

The portions of the second supply channel plate 52 where the supply grooves 56 are formed and the portion where the recess 57 (filter unit 120) is formed are thinner than other portions and hence are liable to bent respectively, and hence a problem of defective adhesion may occur. However, with the provision of the beam portion 62 in the reservoir plate 60A, the second supply channel plate 52 is supported by the beam portion 62, and hence the problem of defective adhesion is prevented.

In the second embodiment, the beam portion 62 is integrally provided with the reservoir plate 60A. However, the second supply channel plate 52 may be supported by a member which is a member separate from the reservoir plate 60A. The beam portion 62 does not necessarily have to be provided in the reservoir plate 60A as long as rigidity of the second supply channel plate 52 is secured.

Other Embodiments

The embodiments of the invention have been described. However, the invention is not limited to those described above.

Figure 6:
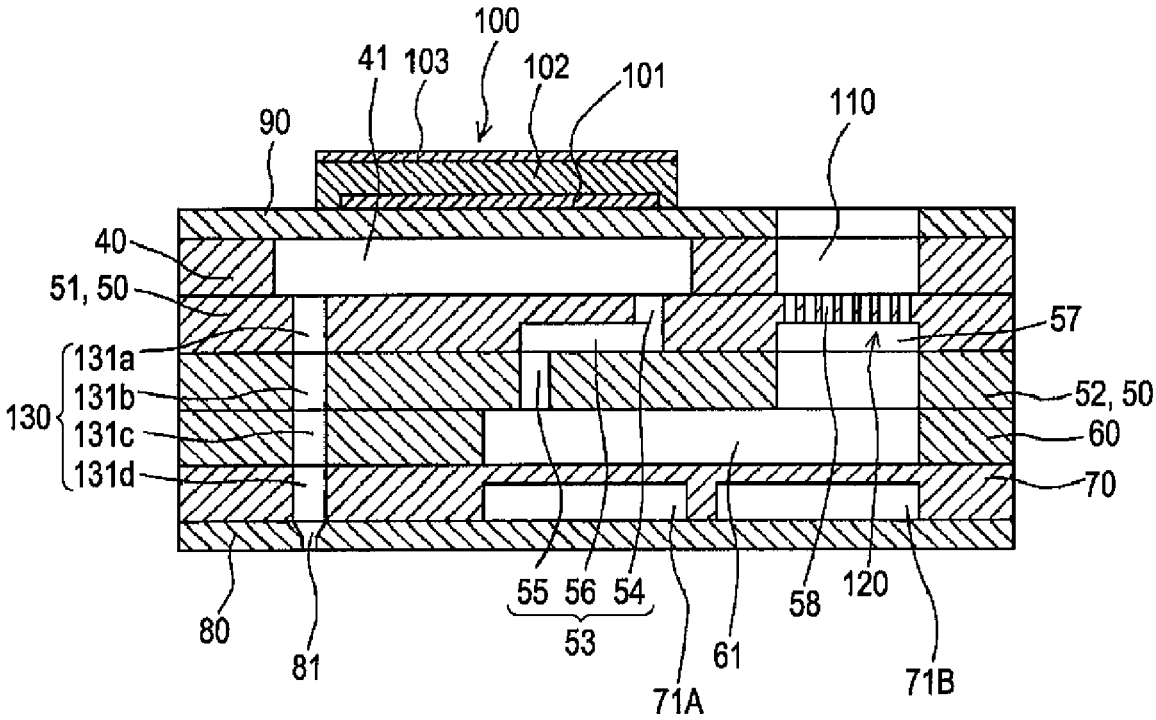
FIG. 6 is a cross-sectional view of the printhead according to another embodiment.

For example, in the embodiment described above, the supply grooves 56 are provided in the second supply channel plate 52 which constitutes the supply channel member 50. However, the invention is not limited thereto and, for example, the supply grooves 56 may be provided on the first supply channel plate 51 as shown in FIG. 6. In this case, the filter unit 120 is also formed in the first supply channel plate 51. In this configuration as well, the same advantages and effects as the embodiments described above are achieved.

In the embodiments described above, the example in which the supply channel member 50 includes two supply channel plates has been described. However, the supply channel member 50 may include three or more supply channel plates. The filter unit must simply be provided at least integrally with the supply channel plate formed with the supply grooves. Accordingly, the same advantages and effects as the embodiments descried above are achieved.

In the embodiments described above, the ink jet printhead having so-called thick film piezoelectric elements in which the respective layers are formed by green sheet adhesion or printing has been described as an example. However, the invention is not limited thereto, and may be applied to an ink jet printhead having (so-called a thin film) piezoelectric elements in which the respective layers are formed by film forming and lithography method or (so-called a vertical oscillation type) piezoelectric elements in which piezoelectric materials and electrode forming materials are laminated alternately and are expanded and contracted in the axial direction. Furthermore, the invention is also applicable to an ink jet printhead having so-called an electrostatic actuator in which an oscillating plate is oscillated by an electrostatic force by generating static electricity between the oscillating plate and the electrode.

Figure 7:
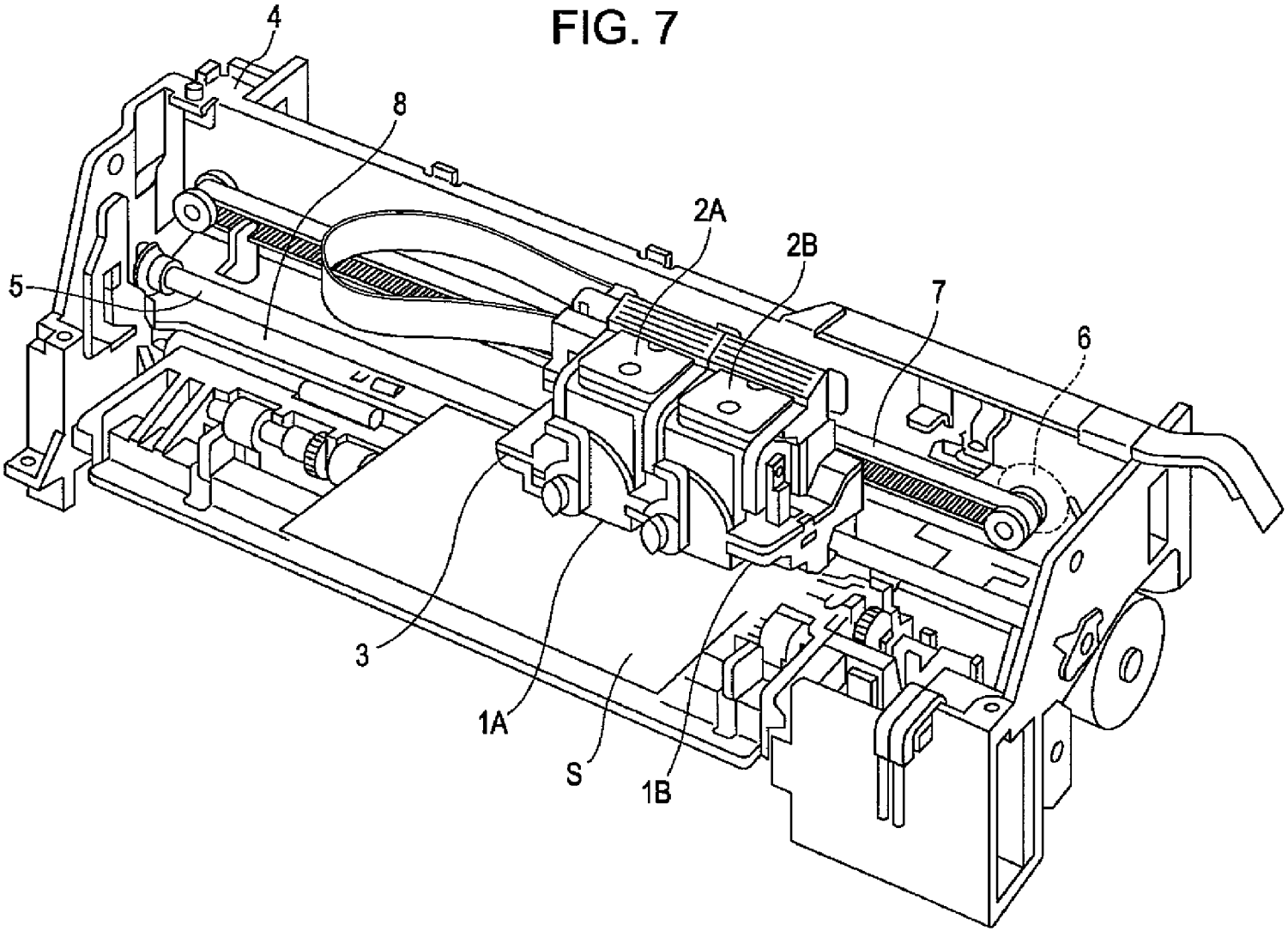
FIG. 7 is a schematic drawing of an ink jet printhead according to an embodiment.

The ink jet printhead as described above constitutes part of the printhead unit having ink flow channels communicating with the ink cartridge or the like and is mounted to an ink jet printing apparatus. FIG. 7 is a schematic drawing showing an example of the ink jet printing apparatus. As shown in FIG. 7, printhead units 1A and 1B having the ink jet printhead include cartridges 2A and 2B which constitute ink supply units demountably mounted thereon, and a carriage 3 having the printhead units 1A and 1B mounted thereon is provided on a carriage shaft 5 attached to an apparatus body 4 so as to be movable in the axial direction. The printhead units 1A and 1B are, for example, adapted to discharge black ink composition and color ink composition, respectively.

Then, with a drive force of a drive motor 6 transmitted to the carriage 3 via a plurality of gears and a timing belt 7, not shown, the carriage 3 having the printhead units 1A and 1B is moved along the carriage shaft 5. On the other hand, the apparatus body 4 includes a platen 8 provided along the carriage shaft 5, and a printing sheet S as a printing medium such as paper fed by a paper-feed roller, not shown is transported on the platen 8.

In the embodiment described above, the ink jet printhead has been described as an example of the liquid ejecting head according to the aspect of the invention. However, the invention is widely applied to general liquid ejecting heads, and is able to be applied to these which eject liquid drops other than ink as a matter of course. As other liquid ejecting heads, for example, various printheads used in an image printing apparatus such as printers, colorant ejecting heads used for manufacturing color filters such as liquid crystal displays, electrode material ejecting heads used for forming electrodes for organic EL displays and FED (field-emission display), and biological organic substance ejecting heads used for biochip manufacture are exemplified.

What is claimed is:

1. A liquid ejecting head comprising:

a flow channel unit comprising:

a pressure chamber plate having a pressure generating chamber capable of ejecting liquid drops;

a reservoir plate formed with a reservoir in which liquid to be supplied to the pressure generating chamber is stored; and a supply channel member arranged between the pressure chamber plate and the reservoir plate and formed with a supply channel which communicates the reservoir and the pressure generating chamber, the supply channel member including a plurality of supply channel plates, and the supply channel including supply holes penetrated through the respective supply channel plates and a supply groove formed by removing part of one of adjacent supply channel plates in terms of the direction of thickness thereof for communicating the respective supply holes; and a supply communication channel that connects a storage unit having the liquid stored therein and the reservoir, the supply communication channel being formed through the pressure chamber plate and the supply channel member in the direction of thickness thereof, the supply channel plates having the supply groove being formed with a recess having the substantially same depth as the supply groove at an area corresponding to the supply communication channel and a filter unit having a plurality of filter holes provided on the bottom of the recess;

wherein the reservoir plate includes a beam portion in an area between a portion opposing the supply channel and a portion opposing the supply communication channel; and a pressure generating element that provides a pressure to the pressure generating chamber.

2. The liquid ejecting head according to claim 1, wherein the flow channel unit further includes: a compliance plate having a compliance portion which is joined on the surface of the reservoir plate opposite from the supply channel plate and is deformed by the pressure change in the interior of the reservoir and a nozzle plate formed with the nozzle and joined to the compliance plate, and wherein the compliance plate is formed with the compliance portion at least at a portion opposing an opening of the supply channel on the side of the reservoir by removing part of the compliance plate in terms of the direction of thickness.

3. The liquid ejecting head according to claim 2, wherein the compliance plate is formed with the compliance portion at a portion opposing the opening of the supply channel on the side of the reservoir and a portion opposing the supply communication channel.

4. The liquid ejecting head according to claim 2, wherein the compliance plate includes a through hole penetrating through the compliance plate in the direction of thickness formed at a portion opposing the supply communication channel, and includes the compliance portion by removing part of the nozzle plate in the direction of thickness at a portion opposing the through hole of the nozzle plate.

5. A liquid ejecting apparatus having a liquid ejecting head according to claim 1.

* * * * *